US006306569B1

(12) United States Patent
Morimura et al.

(10) Patent No.: US 6,306,569 B1
(45) Date of Patent: Oct. 23, 2001

(54) SILVER HALIDE EMULSION, METHOD OF MANUFACTURING THE EMULSION, SILVER HALIDE PHOTOSENSITIVE MATERIAL CONTAINING THE EMULSION, AND METHOD OF DEVELOPING THE MATERIAL

(75) Inventors: Kimiyasu Morimura; Hideo Ikeda, both of Minami-Ashigara (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/261,258

(22) Filed: Mar. 3, 1999

(30) Foreign Application Priority Data

Mar. 6, 1998 (JP) ..... 10-071211

(51) Int. Cl.[7] ..... G03C 1/035
(52) U.S. Cl. ..... 430/567; 430/569
(58) Field of Search ..... 430/567, 569

(56) References Cited

U.S. PATENT DOCUMENTS 4,786,588 11/1988 Ogawa ..... 430/603
5,514,517 5/1996 Waki ..... 430/244

*Primary Examiner*—Hoa Van Le

(57) ABSTRACT

A silver halide emulsion containing chemically sensitized silver halide grains, wherein the silver halide grains are prepared by ripening the grains by the addition of (1) fine silver halide grains smaller than the silver halide grains to be digested, (2) a solution containing silver ions, (3) a solution containing halide ions and a solution containing silver ions, or (4) a fine silver halide grain emulsion and a solution containing silver ions, wherein the amount of the addition in terms of silver ion is 0.05 to 8 mol % per mol of silver in the silver halide grains, and the addition is performed after 40% or more of the reaction of chalcogen sensitizer that is added during the chemical sensitization step is completed and before the silver halide grains are optimally ripened.

20 Claims, No Drawings

SILVER HALIDE EMULSION, METHOD OF MANUFACTURING THE EMULSION, SILVER HALIDE PHOTOSENSITIVE MATERIAL CONTAINING THE EMULSION, AND METHOD OF DEVELOPING THE MATERIAL

BACKGROUND OF THE INVENTION

The present invention relates to a silver halide emulsion and the like and, more particularly, to a silver halide emulsion and the like characterized by a silver halide grain chemical sensitization method.

To improve the graininess of images of color photosensitive materials, particularly color reversal sensitive materials often used by professional photographers, it is necessary to minimize the size of emulsion grains contained in each color sensitive layer. However, the sensitivity generally lowers when the grain size is decreased, so a sensitivity increasing technique is required to compensate for this lowering of the sensitivity. U.S. Pat. Nos. (hereinafter also referred to as U.S.) 4,434,226, 4,439,520, 4,414,310, 4,433,048, 4,414,306, and 4,459,353 have disclosed sensitivity increasing techniques by which the color sensitization ratio by spectral sensitization dyes is improved by increasing the surface area of grains for receiving light by the use of tabular silver halide grains, compared to a case wherein grains of the same size are used. The present inventors have examined grains having an aspect ratio of 2 or more and found that as the aspect ratio is increased, it is possible to use larger amounts of sensitizing dyes and improve the spectral sensitivity.

BRIEF SUMMARY OF THE INVENTION

The present inventors obtained an unexpected result that no desired sensitivity can be obtained even when the aforementioned tabular grains are optimally chemically sensitized if the aspect ratio of the grains is increased. When the aspect ratio is increased, a large color sensitization increase is obtained. However, the intrinsic sensitivity of an emulsion is lower than this increase. It is estimated that this low sensitivity is caused by a factor which makes the rearrangement (aggregation) process (D. J. Cash, J. Photogr. Sci. 20, 19(1972)) insufficient which occurs subsequently to the formation of chalcogen silver in the chemical sensitization process. Accordingly, an epoch-making chemical sensitization method which increases the sensitivity/graininess ratio by suppressing this inefficiency is being demanded.

It is, therefore, an object of the present invention to provide a silver halide emulsion having a high sensitivity/graininess ratio, a method of manufacturing the emulsion, a silver halide photosensitive material containing the emulsion, and a method of processing the sensitive material.

DETAILED DESCRIPTION OF THE INVENTION

The present inventors have made extensive studies to obtain a tabular photographic emulsion having a high sensitivity/graininess ratio and an aspect ratio of 2 or more. Consequently, the present inventors have found that the sensitivity can be increased when chemical sensitization is performed by ripening or digesting silver halide grains by the addition of (1) fine silver halide grains smaller than the silver halide grains, (2) a solution containing silver ions, (3) a solution containing halide ions and a solution containing silver ions, or (4) a fine silver halide grain emulsion and a solution containing silver ions (in either case, the amount of the addition in terms of silver is 0.05 to 8 mol % per mol of silver in the silver halide grains) after the reaction of chemical sensitizers has proceeded to some extent during the chemical sensitization process. This technique is found to have another advantage of being able to decrease the amounts of sensitizers used. Additionally, it is surprising that the effect is particularly notable when the average projected area diameter of grains is 0.5 $\mu$m or less. Accordingly, it is possible to provide tabular grains having both a high aspect ratio and a high sensitivity/graininess ratio.

The present inventors have also confirmed that a similar effect can be obtained when the above chemical sensitization method is applied to regular crystal grains other than tabular grains.

The above object, therefore, is achieved by silver halide emulsions, a method of manufacturing the emulsions, a silver halide photosensitive material containing the emulsions, and a method of developing the material.

(1) A silver halide emulsion containing chemically sensitized silver halide grains, wherein the silver halide grains are prepared by ripening the grains by the addition of (1) fine silver halide grains smaller than the silver halide grains, (2) a solution containing silver ions, (3) a solution containing halide ions and a solution containing silver ions, or (4) a fine silver halide grain emulsion and a solution containing silver ions (in either case, the silver ion content is 0.05 to 8 mol % per mol of silver in the silver halide grains) after 40% or more of the reaction of chalcogen sensitizers are complete and before the silver halide grains are optimally ripened during the chemical sensitization process.

(2) The silver halide emulsion described in item (1) above, wherein the silver halide grains are tabular silver halide grains having an aspect ratio of 2 to 30 and the variation coefficient of the aspect ratio is 30% or less.

(3) The silver halide emulsion described in item (1) or (2) above, wherein the average silver iodide content of the silver halide grains is 0.5 to 10 mol %.

(4) The silver halide emulsion described in any one of items (1) to (3) above, wherein the silver halide grains are subjected to gold-sulfur-selenium sensitization.

(5) The silver halide emulsion described in any one of items (1) to (4) above, wherein the fine silver halide grains or solution containing halide ions to be added during the chemical sensitization process. contains 20 mol % or less of iodide ions.

(6) The silver halide emulsion described in any one of items (1) to (5) above, wherein the fine silver halide grains or solution containing halide ions to be added during the chemical sensitization process contains 10 mol % or less of chloride ions.

(7) A method of manufacturing a silver halide emulsion containing chemically sensitized silver halide grains, wherein the silver halide grains are prepared by ripening the grains by the addition of (1) fine silver halide grains smaller than the silver halide grains, (2) a solution containing silver ions, (3) a solution containing halide ions and a solution containing silver ions, or (4) a fine silver halide grain emulsion and a solution containing silver ions (in either case, the amount of the addition in terms of silver is 0.05 to 8 mol % per mol of silver in the silver halide grains) after 40% or more of the reaction of chalcogen sensitizers are complete and before the silver halide grains are optimally ripened during the chemical sensitization process.

(8) A silver halide photosensitive material having at least one light-sensitive silver halide emulsion layer on a support, wherein the light-sensitive silver halide emulsion layer contains the silver halide emulsion described in any one of items (1) to (6) above.

(9) A silver halide photosensitive material developing method of image-wise exposing and developing the silver halide photosensitive material described in item (8) above, wherein the method comprises a processing step performed in a developer in which a solution physical development occurs.

The present invention will be described in detail below.

In the present invention, optimum ripening indicates the state after the sensitivity rises with the ripening or digesting time and immediately before the sensitivity starts falling when chemical sensitization is performed with a given chemical sensitizer amount. In the present invention, therefore, optimum ripening of silver halide grains means the state after the sensitivity of emulsion containing the silver halide grains rises with the ripening time and immediately before the sensitivity starts falling when predetermined amounts of chemical sensitizers are added.

In the present invention, chalcogen sensitization is chemical sensitization performed by using at least one of a sulfur sensitizer, selenium sensitizer, and tellurium sensitizer (to be described later).

The reaction rate of chalocogen sensitization used in the invention is defined as follows:

The reaction rate of sulfur sensitizer used in the present invention is calculated by a Friezer & Ranz method (Ber. Bunsenges. Phys. Chem. 68, 389(1964)) using radio isotope$^{35}$S, the disclosure of which is herein incorporated by reference.

The reaction rate of selenium or tellurium sensitizer used in the present invention is calculated by washing away the sensitizer which is merely adsorbed to the surfaces of emulsion grains and does not contribute to sensitization, and determining the amount of sensitizer remaining in an emulsion by Zeeman atomic absorption.

When a plurality of chalcogen sensitizers are used in chalcogen sensitization, the reaction rate is calculated from the measured reaction rates of individual chalcogen sensitizers. That is, when 40% or more of the total number of moles of the chalcogen sensitizers added are consumed by reaction, this means that 40% of more of the chalcogen sensitizer reaction are complete.

In the present invention, when chemical sensitization, e.g., noble metal sensitization, other than chalcogen sensitization, is combined with chalcogen sensitization, the reaction rate of chalcogen sensitization can also be calculated in the same manner as in the case where only chalcogen sensitization is performed.

The reaction rate of sensitizer whose reaction rate is accurately calculated by any of the above methods can be simply calculated from light absorption of chalcogen silver having a peak near 520 nm by measuring the diffusion reflectance by referring to an emulsion which is not chemically sensitized.

Silver halide grains used in the emulsion of the present invention preferably have an average silver iodide content of 0.5 to 10 mol % based on the total silver halide of the grains. The average silver iodide content is more preferably 1 to 6 mol %. The boundary of silver iodide-containing layers between structures in a grain can be a distinct boundary or a continuously smoothly changing boundary. Iodide ions can be added during a growth process (to be described later) such that the iodide content after the addition is uniform. The iodide ion concentration can also change such that the concentration is initially high and then continuously lowers or is initially low and then continuously rises. Alternatively, the concentration can discontinuously be changed. Iodide ions can be introduced by simultaneously or separately adding an iodide ion-containing KBr solution and $AgNO_3$. It is also possible to add only a solution containing iodide ions under conditions by which the iodide ions are incorporated into grains. Fine AgI grains can also be used to introduce iodide ions. Dislocation lines can be formed in the major faces or peripheral portion of a grain by iodide gap introduction during grain formation.

Grains can be either regular crystal grains or tabular grains. Tabular grains have parallel major faces and side surfaces connecting these major faces. Tabular grains usually have one or two twin planes between the major faces. Tabular grains used in the present invention can be tabular grains containing such twin planes. However, tabular grains preferably have an average projected area diameter of 0.08 to 2.0 $\mu$m. The side length of cubic regular crystal grains is preferably 0.2 $\mu$m or less. The average projected area diameter is more preferably 0.1 to 0.8 $\mu$m, and most preferably 0.15 to 0.5 $\mu$m.

The variation coefficient of the projected area diameter distribution of grains is preferably 30% or less, and more preferably 25% or less. The projected area diameter and aspect ratio of tabular grain can be measured from an electron micrograph shadowed together with a reference latex sphere by a carbon replica method. The tabular grain commonly has a hexagonal, triangular, or circular shape when viewed in a direction perpendicular to the major faces. The aspect ratio is a value obtained by dividing the diameter of circle having the same area as the projected area by the thickness. The ratio of tabular grains having hexagonal major faces are preferably as high as possible. Also, the length ratio of adjacent sides of the hexagon is preferably 1:2 or less. The average projected area diameter and the aspect ratio are calculated from the average values of the projected area diameters and thicknesses of 100 or more grains contained in a uniform emulsion.

The effect of the present invention in tabular grains is improved when the aspect ratio of the tabular grains has a certain high value. Preferably, 50% or more of the total projected area of tabular grains are accounted for by grains having an aspect ratio of 5 or more. However, if the aspect ratio is too high, the variation coefficient of the grain size distribution described above increases. Usually, therefore, the aspect ratio is preferably 20 or less.

Emulsions of the present invention including tabular silver iodobromide emulsions preferable in the present invention can be prepared by various methods. For example, the preparation of tabular grains basically includes three steps of nucleation, ripening, and growth. In the nucleation step of tabular grain emulsions preferable in the present invention, it is very effective to use gelatin with a small methionine content as described in U.S. Pat. No. 4,713,320 and U.S. Pat. No. 4,942,120, perform nucleation at a high pBr as described in U.S. Pat. No. 4,914,014, and perform nucleation within a short time period as described in Jpn. Pat. Appln. KOKAI Publication No. (hereinafter referred to as JP-A-) 2-222940, all the disclosures of which are incorporated herein by reference. In the ripening or digesting step of tabular portions of grains of the present invention, it is sometimes effective to perform the ripening in the presence of a low-concentration base as described in U.S. Pat. No. 5,254,453 or at a high pH as described in U.S. Pat. No. 5,013,641, all the disclosures of which are incorporated herein by reference. In the growth step of emulsion grains of the present invention, it is particularly effective to perform the growth at a low temperature as described in U.S. Pat. No. 5,248,587 or use fine silver iodide grains as described in U.S. Pat. No. 4,672,027 and U.S. Pat. No. 4,693,964, all the disclosures of which are incorporated herein by reference.

In a method of manufacturing emulsions of the present invention, a chemical sensitization step is usually performed after the grain growth step, e.g., after grains are desalted by being washed with water.

When chemical sensitization is performed by using a plurality of different chemical sensitizers, these chemical sensitizers can be added either simultaneously or separately.

The emulsion temperature, pH, and pAg during the chemical sensitization can usually be maintained at 30 to 90° C., 4 to 9, and 7 to 10, respectively.

One chemical sensitization which can be preferably performed in the present invention is chalcogenide sensitization, noble metal sensitization, or a combination of these. This sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at a pAg of 5 to 10, a pH of 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755, all the disclosures of which are incorporated herein by reference. In the noble metal sensitization, salts of noble metals, such as gold, platinum, palladium, and iridium, can be used. In particular, gold sensitization, palladium sensitization, or the combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, a palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable to use a gold compound and palladium compound in combination with a thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457, all the disclosures of which are incorporated herein by reference. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, "Photographic Emulsion Chemistry", pages 138 to 143, all the disclosures of which are incorporated herein by reference.

Emulsions of the present invention are preferably subjected to chalcogen sensitization and gold sensitization. The amount of gold sensitizer is preferably $1\times10^{-4}$ to $1\times10^{-7}$, and more preferably $1\times10^{-5}$ to $5\times10^{-7}$ mol per mol of a silver halide. The amount of palladium compound is preferably $1\times10^{-3}$ to $5\times10^{-7}$ mol per mol of a silver halide. The amount of thiocyanate or selenocyanate is $5\times10^{-2}$ to $1\times10^{-6}$ mol per mol of a silver halide.

The amount of chalcogen sensitizer used in silver halide grains of the present invention is preferably $1\times10^{-4}$ to $1\times10^{-7}$ mol per mol of a silver halide, and more preferably $1\times10^{-5}$ to $5\times10^{-7}$.

More specifically, grains used in the present invention are preferably subjected to gold-sulfur sensitization. Although it is preferable to sensitize the grain surfaces, the interiors of grains can also be sensitized. The grain surface indicates a region 10 Å inside the interface between the silver halide grain surface and gelatin covering the grain or a substance adsorbed to the grain. The grain interior is a portion inside this region. Chemical sensitization of the grain interior is ineffective if the sensitization is performed in a portion deeper than 200 Å. Surface sensitization is preferable not only in gold-sulfur sensitization but also in chalcogen sensitization.

Grains used in the present invention are preferably subjected to gold-selenium sensitization. The selenium sensitization used in the present invention means a sensitization process using selenium sensitizers presented below.

That is, labile selenium compounds can be used in the selenium sensitization. Preferable compounds are described in, e.g., U.S. Pat. No. 3,297,446, U.S. 3,297,447, JP-A-4-25832, JP-A-4-109240, JP-A-4-147250, JP-A-4-271341, JP-A-5-40324, JP-A-5-224332, JP-A-5-224333, JP-A-5-11385, JP-A-6-43576, JP-A-6-75328, JP-A-6-175258, JP-A-6-175259, JP-A-6-180478, JP-A-6-208184, and JP-A-6-208186, all the disclosures of which are incorporated herein by reference.

Specific examples are phosphine selenides (e.g., triphenylphosphineselenide, diphenyl(pentafluorophenyl) phosphineselenide), selenophosphates (e.g., tri-p-tolylselenophosphate), selenophosphinic acid esters, selenophosphonic acid esters, selenoureas (e.g., N,N-dimethylselenourea, N-acetyl-N,N',N'-trimethylselenourea, N-trifluoroacetyl-N,N',N'-trimethylselenourea), selenoamides (e.g., N,N-dimethylselenobenzamide, N,N-diethylselenobenzamide), selenoesters (e.g., p-methoxyselenobenzoic acid o-isopropylester, p-methoxyselenobenzoic acid Se-(3'-oxocyclohexyl)ester), diacylselenides (e.g., bis(2,6-dimethoxybenzoyl)selenide, bis(2,4-dimethoxybenzoyl)selenide), dicarbamoylselenides (e.g., bis(N,N-dimethylcarbamoyl)selenide), bis (alkoxycarbonyl)selenides (e.g., bis(n-butoxycarbonyl) selenide, bis(benzyloxycarbonyl)selenide), triselenanes (e.g., 2,4,6-tris(p-methoxyphenyl)triselenane), diselenides, polyselenides, seleniumsulfide, selenoketones, selenocarboxylic acids, isoselenocyanates, and colloidal selenium. Preferably, phosphineselenides, selenoamides, dicarbamoylselenides, bis(allkoxycarbonyl)selenides, and selenoesters are used.

Additionally, it is possible to use non-labile selenium compounds described in Jpn. Pat. Appln. KOKOKU Publication Nos. (hereinafter referred to as JP-B-) 46-4553 and 52-34492, e.g., sodium selenite, potassium selenocyanate, selenazoles, and selenides, all the disclosures of which are incorporated herein by reference.

Grains used in the present invention are preferably subjected to gold-tellurium sensitization. The tellurium sensitization used in the present invention means a sensitization process using tellurium sensitizers presented below.

That is, labile tellurium compounds are used in tellurium sensitization. It is possible to use labile tellurium compounds described in, e.g., JP-A-4-224595, JP-A-4-271341, JP-A-4-333043, JP-A-5-303157, JP-A-6-27573, JP-A-6-175258, JP-A-6-180478, JP-A-6-208184, JP-A-6-208186, JP-A-6-317867, JP-A-7-140579, JP-A-7-301879, and JP-A-7-301880, all the disclosures of which are incorporated herein by reference.

More specifically, it is possible to use phosphinetellurides (e.g., normalbutyl-diisopropylphosphinetelluride, triisobutylphosphinetelluride, trinormalbutoxyphosphinetelluride, triisopropylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl)telluride), telluroureas (e.g., N,N'-dimethylethylenetellurourea), telluroamides, and telluroesters. Preferable compounds are phosphinetellurides and diacyl(di)tellurides.

The use amount of the selenium and tellurium sensitizers described above changes in accordance with silver halide grains used and chemical sensitization conditions. However, the use amount is $10^{-8}$ to $10^{-2}$ mol, preferably $10^{-7}$ to $10^{-3}$ mol per mol of a silver halide.

Although the conditions of selenium sensitization and tellurium sensitization are not particularly limited, the pAg, pH, and temperature are 6 to 11, 4 to 10, and 40° to 95° C., preferably 7 to 10, 5 to 8, and 45° C. to 85° C., respectively.

Grains of the present invention are preferably subjected to gold-chalcogen sensitization at a composition ratio realizable by sulfur, selenium, and tellurium, and most preferably subjected to gold-sulfur-selenium sensitization.

Fine silver halide grains used in the chemical sensitization process for digestion of the present invention can have any crystal habits and contain twin planes provided that the grain size (equivalent-sphere diameter) is smaller than that of tabular silver halide grains used in the present invention. That is, the grain size of the fine silver halide grains is smaller than that of the silver halide grains before performing digestion. The silver halide composition of the fine silver halide grains can be any of silver chloride, silver bromide, silver iodobromide, silver chlorobromide, and silver bromochloroiodide. The history of grain formation can also be any history. The average iodide ion content of the fine silver halide grains is desirably 0 to 20 mol %, and more desirably 0.3 to 10 mol % with respect to the total silver halide content in the fine grains.

In the preparation of the emulsion of the present invention, four alternative method of chemical sensitization for ripening is performed in the chemical sensitization process.

That is, the fine silver halide grains smaller than the silver halide grains are added (hereinafter also referred to as addition method (1)). It is also possible to add a solution containing silver ions such as an aqueous silver nitrate solution (hereinafter also referred to as addition method (2)). It is also possible to add a solution containing halide ions, such as an aqueous solution containing at least one alkali metal salt of bromine, chlorine, or iodine, and a solution containing silver ions (hereafter also referred to as addition method (3)). It is also possible to add fine silver halide grains and a solution containing silver ions (hereafter also referred to as addition method (4)).

In the addition method (3), the total molar amount of the halide ions is the same as the molar amount of the silver ions. When the solution containing halide ions is added, the iodide ion content in the solution is desirably 0 to 20 mol %, and more desirably 0.3 to 10 mol % of the total halide ion content in the halide ion-containing solution.

In the present invention, the chloride ion content in the fine silver halide grains used in the chemical sensitization process of the present invention is desirably 0 to 10 mol % of the fine silver halide grains. When the solution containing halide ions and the solution containing silver ions are added in place of the fine silver halide grains, the content of chloride ions added is desirably 0 to 10 mol % of the total halide ion content in the halide ion-containing solution, in the same manner as in the addition of the fine silver halide grains.

In the chemical sensitization process of the silver halide grains used in the present invention, the amount of the fine silver halide grains used in the addition method (1), the amount of silver ions used in the addition method (2), the amount of halide ions used in the addition method (3), which is the same amount as the silver ions used in the method, and the total amount of silver ions contained in the silver halide fine grains and the solution containing silver ions in the addition method (4), is 0.05 to 8 mol %, desirably 0.2 to 5 mol % of chemically unsensitized silver halide grains. If the use amount of the fine silver halide grains or halide ions is too large, the image center is unintentionally unpreferably embedded inside a grain.

In the present invention, addition methods (1) to (4) described above can be performed preferably after 40% or more of the chalcogen sensitization reaction are complete and before optimum sensitization, and more preferably after 60% or more of the chalcogen sensitization reaction are complete and before optimum ripening.

In any of addition methods (1) to (4) above, the addition can be performed in a short time period within the above range or over the entire period of the range.

When two different aqueous solutions are added as in addition methods (3) and (4) above, these solutions are preferably simultaneously added, although they can also be added separately.

In the present invention, of aforementioned addition methods (1) to (4) the addition of the fine silver halide grains and the aqueous solution containing silver ions (i.e., addition method (4)) is preferable. The addition of the fine silver halide grains can be made in a form of an emulsion containing the fine grains.

An emulsion grain of the present invention particularly effectively contains a reduction-sensitized region in one or both of the interior and surface of the grain. The definitions of the surface and interior of a grain are the same as above. The reduction-sensitized region can be formed by any of a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be combined together.

The method of adding reduction sensitizers is preferable in that the level of reduction sensitization can be finely adjusted.

Known examples of the reduction sensitizers are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more different compounds together. Compounds preferable as the reduction sensitizer are stannous chloride, thiourea dioxide, dimethylamineborane, and ascorbic acid and its derivative. Although the addition amount of reduction sensitizers must be so selected as to meet the emulsion manufacturing conditions, a preferable amount is $10^{-7}$ to $10^{-3}$ mol per mol of a silver halide.

The reduction sensitizers are dissolved in water or a solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers can be added separately several times or continuously over a long time period with grain growth.

The reduction sensitization can be performed in any of the grain preparation step, the subsequent washing step, and the chemical sensitization (after-ripening) step.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer; a protein such as albumin, and casein; a cellulose derivative such as hydroxyethylcellulose, carboxymethylcellulose, and cellulose sulfates, and a sugar derivative such as soda alginate and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). It is also possible to use gelatin processed by phthalic acid described in JP-A-8-82883. In addition, a hydrolyzed product or an enzyme-decomposed product of gelatin can be used.

It is preferable to wash an emulsion of the present invention for a desalting purpose to form a newly prepared protective colloid dispersion. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

It is preferable to use an oxidizer for silver during the process of manufacturing emulsions of the present invention. An oxidizer for silver means a compound having an effect of converting metal silver into silver ion. A particularly effective compound is a compound that converts very fine silver grains, as a by-product in the process of formation of silver halide grains and chemical sensitization, into silver ion. The silver ion produced may form a silver salt hard to dissolve in water, such as a silver halide, silver sulfide, or silver selenide, or a silver salt easy to dissolve in water, such as silver nitrate. The oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O)$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate. Examples of the organic oxidizer are quinones such as p-quinone, an organic peroxide such as peracetic acid and perbenzoic acid, and a compound which releases active halogen (e.g., N-bromosuccinimide, chloramine T, and chloramine B).

Preferable oxidizers usable in the present invention are ozone, hydrogen peroxide and its adduct, a halogen element, and thiosulfonate as inorganic oxidizers, and quinones as organic oxidizers. It is preferable to use both the reduction sensitization described above and the oxidizer for silver. In this case, the reduction sensitization can be performed after the oxidizer is used or vice versa, or the reduction sensitization and the use of the oxidizer can be performed at the same time. These methods can be selectively performed during or after the grain formation step.

An emulsion of the present invention can be any of a surface latent image type emulsion which primarily forms a latent image on the surface of a grain, an internal latent image type emulsion which forms a latent image in the interior of a grain, and an emulsion which forms a latent image both on the surface and in the interior of a grain. However, an emulsion must be a negative type emulsion. In a chemical sensitization process of the internal latent image type emulsion, shell formation is performed after 40% or more of the reaction of chalcogen sensitizers are complete and, as described above, silver ions and the like are added and ripened. The internal latent image type emulsion can also be a core/shell internal latent image type emulsion described in JP-A-63-264740. A method of preparing this core/shell internal latent image type emulsion is described in JP-A-59-133542. Although the thickness of the shell of this emulsion depends upon, e.g., the development processing, it is preferably 3 to 40 nm, and most preferably 5 to 20 nm.

A silver halide photosensitive material having silver halide emulsions of the present invention in at least one sensitive layer thereof can be subjected to conventionally used development after being exposed.

A developer used in this development can be either a surface developer which selectively develops only a surface latent image or a developer which contains a silver halide solvent such as sodium sulfite or potassium bisulfite and causes a solution physical development to also develop an internal latent image. The latter developer can achieve the effect of emulsion grains of the present invention more easily. The addition amount of the silver halide solvent can be an amount used in a common developer.

Photographic emulsions of the present invention can contain various compounds in order to prevent fog during the manufacturing process, storage, or photographic processing of a sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; and azaindenes such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions of the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B-43-4936, JP-B-53-12375, JP-A-52-110618, and JP-A-52-109925.

In addition to the sensitizing dyes, emulsions can contain dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after the completion of chemical sensitization and before coating. However, it is possible to perform the addition at the same timing as the addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before the completion of formation of a silver halide grain precipitation to start spectral sensitization. Alternatively, as disclosed in U.S. Pat. No. 4,225,666, these compounds can be added separately; i.e., a portion of the compounds can be added prior to chemical sensitization, while the remaining portion is added after that. That is, the compounds can be added at any timing during formation of silver halide grains, including a method disclosed in U.S. Pat. No. 4,183,756. Although the addition amount can be $4\times10^{-6}$ to $8\times10^{-3}$ mol per mol of a silver halide, an addition amount of $5\times10^{-5}$ to $5\times10^{-3}$ mol is more effective.

The emulsions of the present invention can be added to any sensitive layer, i.e., any of red-, green-, and blue-sensitive layers in a silver halide photosensitive material. When a single sensitive layer of a silver halide photosensitive material is composed of a plurality of sub-layers having different sensitivities, emulsions of the present invention can be added to any of these sub-layers. The addition amount of the emulsion of the present invention can be set between 0.05 and 6.0 g as a silver amount per $m^2$ of a sensitive material.

In silver halide photographic emulsions of the present invention and silver halide photosensitive materials using the emulsions, it is generally possible to use various techniques and inorganic and organic materials described in Research Disclosure No. 308119 (1989) and No. 37038 (1995), the disclosures of which are herein incorporated by reference.

More specifically, techniques and inorganic and organic materials usable in color photosensitive materials to which silver halide photographic emulsions of the present invention can be applied are described in portions of EP436, 938A2 and patents cited below, the disclosures of which are herein incorporated by reference.

| Items | Corresponding portions |
|---|---|
| 1. Yellow couplers | page 137, line 35, to page 146, line 33, and page 149, lines 21 to 23 |
| 2. Magenta couplers | page 149, lines 24 to 28; EP421,453A1, page 3, line 5 to page 25, line 55 |
| 3. Cyan couplers | page 149, lines 29 to 33; EP432,804A2, page 3, line 28 to page 40, line 2 |

-continued

| Items | Corresponding portions |
|---|---|
| 4. Polymer couplers | page 149, lines 34 to 38; EP435,334A2, page 113, line 39 to page 123, line 37 |
| 5. Colored couplers | page 53, line 42 to page 137, line 34, and page 149, lines 39 to 45 |
| 6. Other functional couplers | page 7, line 1 to page 53, line 41, and page 149, line 46 to page 150, line 3; EP435,334A2, page 3, line 1 to page 29, line 50. |
| 7. Antiseptic and mildewproofing agents | page 150, lines 25 to 28 |
| 8. Formalin scavengers | page 149, lines 15 to 17 |
| 9. Other additives | page 153, lines 38 to 47; EP421,453A1, page 75, line 21 to page 84, line 56, and page 27, line 40 to page 37, line 40. |
| 10. Dispersion methods | page 150, lines 4 to 24 |
| 11. Supports | page 150, lines 32 to 34 |
| 12. Thickness and physical properties of film | page 150, lines 35 to 49 |
| 13. Color development-black-and-white development-fogging process | page 150, line 50 to page 151, line 47; EP442,323A2, page 34, lines 11 to 54, and page 35, lines 14 to 22 |
| 14. Desilvering process | page 151, line 48 to page 152, line 53 |
| 15. Automatic processor | page 152, line 54 to page 153, line 2 |
| 16. Washing-stabilizing process | page 153, lines 3 to 37 |

EXAMPLES

The present invention will be described in more detail below by way of its examples, but the invention is not limited to these examples.

Example 1

Preparation of Emulsion Em-a

An aqueous solution prepared by dissolving 6 g of potassium bromide and 0.8 g of low-molecular-weight gelatin having an average molecular weight of 10,000 to 20,000 in 1.5 L of distilled water was well stirred, and an aqueous solution containing 64 g of KBr and 5.0 g of low-molecular-weight gelatin in 500 cc and an aqueous solution containing 90 g of silver nitrate and 4 g of ammonium nitrate in 500 cc were added at 35° C. over 30 sec by the double-jet method. During the addition, the pAg was held at 9.0. (In this addition (1), 5.7% of the total silver amount were consumed.) After physical ripening was performed, the pAg was adjusted to 9.5 by an aqueous KBr solution, and the solution temperature was raised to 50° C. After that, 35 g of gelatin processed with phthalic acid were added, and an aqueous solution containing 215.7 g of KBr and 11.6 g of KI in 1 L and an aqueous solution containing 316 g of silver nitrate and 0.6 g of ammonium nitrate in 1 L were added over 28 min by the double-jet method. During the addition, the pAg was held at 8.8. (In this addition (2), 94.3% of the total silver amount were consumed.) The resultant emulsion was washed with water at 35° C. by a well-known flocculation method, gelatin was added, and the pH and the pAg were adjusted to 6.3 and 8.3, respectively, at 40° C. The result was a tabular AgBrI emulsion (average I=3.5 mol %, projected area diameter variation coefficient (hereafter referred to as variation coefficient)=24%) having an average grain diameter of 0.23 μm as the diameter of sphere having the same volume as a grain, an average projected area diameter of 0.32 μm, and an average aspect ratio of 4.4.

This emulsion was heated to 56° C., and gold-sulfur-selenium sensitization was optimally performed in the presence of potassium thiocyanate by using hypo as a sulfur sensitizer, N,N,-dimethylselenourea as a selenium sensitizer, and chloroauric acid as a gold sensitizer, thereby obtaining an emulsion Em-a.

Preparation of Emulsion Em-b

Grains were prepared by performing physical ripening after step (1), adjusting the pAg to 9.5 by an aqueous KBr solution, raising the solution temperature to 50° C., adding 35 g of phthalic acid-processed gelatin, and separating solution addition step (2) into solution addition step (2) and solution addition step (3) as follows in the preparation process of the emulsion Em-a.

An aqueous solution containing 225 g of KBr in 1 L and an aqueous solution containing 316 g of silver nitrate and 0.6 g of ammonium nitrate in 1 L were added over 20.5 min by the double-jet method. During the addition, the pAg was held at 8.8. (In this addition (2), 52.3% of the total silver amount were consumed.) Subsequently, an aqueous solution containing 205.0 g of KBr and 26.6 g of KI in 1 L and an aqueous solution containing 316 g of silver nitrate and 0.6 g of ammonium nitrate in 1 L were added over 7.8 min by the double-jet method. During the addition, the pAg was held at 8.8. (In this addition (3), 42% of the total silver amount were consumed.) The resultant emulsion was washed with water at 35° C. by a well-known flocculation method, gelatin was added, and the pH and the pAg were adjusted to 6.3 and 8.3, respectively, at 40° C. The result was a tabular AgBrI emulsion (average I=10 mol %, variation coefficient=25%) having an average grain diameter of 0.23 μm as the diameter of sphere having the same volume as a grain, an average projected area diameter of 0.31 μm, and an average aspect ratio of 4.4. This emulsion was heated to 56° C., and gold-sulfur-selenium sensitization was optimally performed in the same manner as for the emulsion Em-a, thereby obtaining an emulsion Em-b.

Preparation of Emulsion Em-c

Grains were prepared by performing physical ripening after step (1), adjusting the pAg to 9.5 by an aqueous KBr solution, raising the solution temperature to 50° C., adding 35 g of phthalic acid-processed gelatin, and separating solution addition step (2) into solution addition step (2) and solution addition step (3) as follows in the preparation process of the emulsion Em-a.

An aqueous solution containing 225 g of KBr in 1 L and an aqueous solution containing 316 g of silver nitrate and 0.6 g of ammonium nitrate in 1 L were added over 21 min by the double-jet method. During the addition, the pAg was held at 8.8. (In this addition (2), 54.3% of the total silver amount were consumed.)

Subsequently, an aqueous solution containing 153.5 g of KBr and 63.4 g of KI in 1 L and an aqueous solution containing 316 g of silver nitrate and 0.6 g of ammonium nitrate in 1 L were added over 7 min by the double-jet method. During the addition, the pAg was held at 8.8. (In this addition (3), 40% of the total silver amount were consumed.) The resultant emulsion was washed with water at 35° C. by a well-known flocculation method, gelatin was added, and the pH and the pAg were adjusted to 6.3 and 8.3, respectively, at 40° C. The result was a tabular AgBrI emulsion (average I=10 mol %, variation coefficient=24%) having an average grain diameter of 0.23 μm as the diameter of sphere having the same volume as a grain, an average projected area diameter of 0.31 μm, and an average aspect ratio of 4.4. This emulsion was heated to 56° C., and gold-sulfur-selenium sensitization was optimally performed in the same manner as for the emulsion Em-a, thereby obtaining an emulsion Em-c.

Preparation of Emulsion Em-d

Grains were prepared by performing physical ripening after step (1), adjusting the pAg to 9.5 by an aqueous KBr solution, raising the solution temperature to 50° C., adding 35 g of phthalic acid-processed gelatin, and separating solution addition step (2) into solution addition step (2), solution addition step (3), and solution addition step (4) as follows in the preparation process of the emulsion Em-a.

An aqueous solution containing 225 g of KBr in 1 L and an aqueous solution containing 316 g of silver nitrate and 0.6 g of ammonium nitrate in 1 L were added over 14 min by the double-jet method. During the addition, the pAg was held at 8.8. (In this addition (2), 9.2% of the total silver amount were consumed.)

Next, equal equivalent weights of an aqueous solution containing 17.2 g of KI in 1 L and an aqueous solution containing 67.5 g of silver nitrate and 13.2 g of ammonium nitrate in 1 L were added over 6 min 30 sec by the double-jet method. (In this addition (3), 3.5% of the total silver amount were consumed.)

Subsequently, the aqueous KBr solution and aqueous silver nitrate solution used in addition step (2) were added over 30 min with the pAg held at 8.8. (In this addition (4), 81% of the total silver amount were consumed.)

The resultant emulsion was washed with water at 35° C. by a well-known flocculation method, gelatin was added, and the pH and the pAg were adjusted to 6.3 and 8.3, respectively, at 40° C. The result was a tabular AgBrI emulsion (average I=3.5 mol %, variation coefficient=20%) having an average grain diameter of 0.23 μm as the diameter of sphere having the same volume as a grain, an average projected area diameter of 0.28 gm, and an average aspect ratio of 2.7. This emulsion was heated to 56° C., and gold-sulfur-selenium sensitization was optimally performed in the same manner as for the emulsion Em-a, thereby obtaining an emulsion Em-d.

Preparation of Emulsion Em-e

An emulsion Em-e was prepared following the same procedure as for the emulsion Em-d except that $3\times10^{-5}$ mol of thiourea dioxide was added as a reduction sensitizer per mol of silver of a complete grain following physical ripening after addition step (1), and $2.5\times10^{-4}$ mol of $C_2H_5$—$SO_2S$—Na was added per mol of silver after addition step (4).

The reaction rates of sulfur sensitizer and selenium sensitizer in the emulsions Em-a to Em-e were determined by using the Friezer & Ranz method and Zeeman atomic absorption, respectively.

When 70% of the reactions of the individual chemical sensitizers were complete in the emulsions Em-a to Em-e, fine silver bromide grains (0.05 μm) equivalent in amount to 0.2 mol % of the grains were added, and the emulsions were kept ripened or digested and optimally chemically sensitized to obtain emulsions Em-a' to Em-e', respectively.

Also, when 70% of the reactions of the individual chemical sensitizers were complete in the emulsion Em-a, fine silver chloride grains (0.07 μm) equivalent in amount to 0.1 mol % of the grains were added, and the emulsion was kept ripened or digested and optimally chemically sensitized to obtain an emulsion Em-a".

Table 1 below shows the average grain diameter (μm) as the diameter of sphere having the same volume as a grain, projected area diameter (μm), halogen structure, aspect ratio, average iodide amount (mol %), and presence/absence of a reduction-sensitized region of the emulsions Em-a to Em-e, Em-a' to Em-e', and Em-a".

TABLE 1

| Emulsion | Average grain diameter of sphere having the same volume (μm) | Diameter of projected area (μm) | Aspect ratio | Average iodide content (mol %) | Presence or absence of dislocation Lines | Presence or absence of region being reduction sensitized | Silver halide composition of fine grains that were added during chemical sensitization | |
|---|---|---|---|---|---|---|---|---|
| Em-a | 0.23 | 0.32 | 4.4 | 3.5 | Absent | Absent | Not added | Comparison |
| Em-b | 0.23 | 0.31 | 4.4 | 3.5 | Absent | Absent | Not added | Comparison |
| Em-c | 0.23 | 0.31 | 4.4 | 10.0 | Absent | Absent | Not added | Comparison |
| Em-d | 0.23 | 0.28 | 2.7 | 3.5 | Present | Absent | Not added | Comparison |
| Em-e | 0.23 | 0.28 | 2.7 | 3.5 | Present | Present | Not added | Comparison |
| Em-a' | 0.23 | 0.32 | 4.4 | 3.5 | Absent | Absent | AgBr | Invention |
| Em-b' | 0.23 | 0.31 | 4.4 | 3.5 | Absent | Absent | AgBr | Invention |
| Em-c' | 0.23 | 0.31 | 4.4 | 10.0 | Absent | Absent | AgBr | Invention |
| Em-d' | 0.23 | 0.28 | 2.7 | 3.5 | Present | Absent | AgBr | Invention |
| Em-e' | 0.23 | 0.28 | 2.7 | 3.5 | Present | Present | AgBr | Invention |
| Em-a" | 0.23 | 0.32 | 4.4 | 3.5 | Absent | Absent | AgCl | Invention |

A compound described below was added to the emulsions Em-a to Em-e, Em-a' to Em-e', and Em-a". A triacetylcellulose film support having an undercoat layer was coated with each resultant emulsion and a protective layer by a simultaneous extrusion method, thereby forming samples 101 to 111.

| | |
|---|---|
| (1) Emulsion layers | |
| Emulsion | one of emulsions Em-a to Em-e, Em-a' to Em-e', and Em-a" (respectively corresponding to samples 101 to 111) |
| Stabilizer | 4-hydroxy-6-methyl-1,3,3a,7-tetrazaindene |
| (2) Protective layer | |
| Gelatin | |

These samples were given appropriate sensitometry exposure (1 sec) with light transmitted through a Fuji Filter BPN42 and subjected to black-and-white development at 20° C. for 10 min by using a developer D-19 having the following composition. After that, each resultant sample was stopped, fixed, washed with water, and dried by conventional methods, and the density of the sample was measured.

The composition of the processing solution D-19 is as follows.

| | |
|---|---|
| Metol | 2.2 g |
| $Na_2SO_3.7H_2O$ | 96 g |
| Hydroquinone | 8.8 g |
| $Na_2CO_3$ | 56 g |
| KBr | 5.0 g |
| Water to make | 1.0 L |

Table 2 below shows the results of fog, sensitivity, and optimum dye amount used in each emulsion. The sensitivity is defined by the reciprocal of an exposure amount by which a density half the sum of the fog and maximum density is given. A sensitivity difference from the value of the sample 101 is indicated by a relative value logE.

TABLE 2

| Sample No. | Emulsion used | Fogging (Optical density) | Relative sensitivity (log E) | Increment in sensitivity by the invention (log E) | |
|---|---|---|---|---|---|
| 101 | Em-a | 0.05 | 0.00 | — | Comparison |
| 102 | Em-b | 0.04 | −0.25 | — | Comparison |
| 103 | Em-c | 0.03 | −0.20 | — | Comparison |
| 104 | Em-d | 0.05 | +0.10 | — | Comparison |
| 105 | Em-e | 0.06 | +0.20 | — | Comparison |
| 106 | Em-a' | 0.05 | +0.25 | +0.25 | Invention |
| 107 | Em-b' | 0.05 | +0.20 | +0.45 | Invention |
| 108 | Em-c' | 0.04 | +0.23 | +0.43 | Invention |
| 109 | Em-d' | 0.05 | +0.28 | +0.18 | Invention |
| 110 | Em-e' | 0.06 | +0.28 | +0.08 | Invention |
| 111 | Em-a" | 0.12 | +0.30 | +0.30 | Invention |

Table 2 above shows that the sensitivity is increased by the chemical sensitization method of the present invention regardless of the average silver iodide content, presence/absence of dislocation lines, and presence/absence of a reduction-sensitized region.

grain, an average projected area diameter of 0.49 μm, and an average aspect ratio of 4.4. Similarly, a tabular AgBrI emulsion having an average grain size of 0.43 μm as the diameter of sphere having the same volume as a grain, an average projected area diameter of 0.61 μm, and an average aspect ratio of 4.4 was prepared as an emulsion Em-g.

Also, a tabular AgBrI emulsion having an average grain size of 0.51 μm as the diameter of sphere having the same volume as a grain, an average projected area diameter of 0.81 μm, and an average aspect ratio of 6.0 was prepared as an emulsion Em-h.

A chemically unsensitized emulsion of the emulsion Em-a and the emulsions Em-f, Em-g, and Em-h were made to adsorb a dye S-a at 40° C. for 20 min, which was optimum in amount for performing chemical sensitization. The resultant emulsions were heated to 56° C., and gold-sulfur-selenium sensitization was optimally performed in the presence of potassium thiocyanate by using hypo as a sulfur sensitizer, N,N,-dimethylselenourea as a selenium sensitizer, and chloroauric acid as a gold sensitizer, thereby obtaining emulsions Em-A, Em-F, Em-G, and Em-H.

Following the same procedure as above, a chemically unsensitized emulsion of the emulsion Em-a and the emulsions Em-f, Em-g, and Em-h were made to adsorb the dye. When 80% of the chemical sensitizer reaction were complete during gold-sulfur-selenium sensitization, 7 mol % (in terms of silver ions) of an aqueous silver nitrate solution and 7 mol % (in terms of halide ions) of a 1:1 mixture of an aqueous KBr solution and an aqueous KI solution; 11 mol % (in terms of silver ions) of an aqueous silver nitrate solution and 11 mol % (in terms of halide ions) of a 1:1 mixture of an aqueous KBr solution and an aqueous KI solution, were added per mol of a silver halide of a grain. The resultant emulsions were kept ripened or digested and optimally chemically sensitized to prepare emulsions Em-A', Em-A", Em-F', Em-F", Em-G', Em-G", Em-H', and Em-H". Details are shown in Table 3 below.

TABLE 3

| Emulsion | Diameter of sphere having the same volume (μm) | Diameter of projected area (μm) | Aspect ratio | Amount of $AgNO_3$ that was added during chemical sensitization (mol %) | |
|---|---|---|---|---|---|
| Em-A | 0.23 | 0J32 | 4.4 | — | Comparison |
| Em-A' | 0.23 | 0.32 | 4.4 | 7 | Invention |
| Em-A" | 0.23 | 0.32 | 4.4 | 11 | Comparison |
| Em-F | 0.34 | 0.49 | 4.4 | — | Comparison |
| Em-F' | 0.34 | 0.49 | 4.4 | 7 | Invention |
| Em-F" | 0.34 | 0.49 | 4.4 | 11 | Comparison |
| Em-G | 0.43 | 0.61 | 4.4 | — | Comparison |
| Em-G' | 0.43 | 0.61 | 4.4 | 7 | Invention |
| Em-G" | 0.43 | 0.61 | 4.4 | 11 | Comparison |
| Em-H | 0.51 | 0.81 | 6.0 | — | Comparison |
| Em-H' | 0.51 | 0.81 | 6.0 | 7 | Invention |
| Em-H" | 0.51 | 0.81 | 6.0 | 11 | Comparison |

Regular crystal grain emulsions were also prepared and compared to each other, and it was found that the chemical sensitization method of the present invention had a similar effect on these emulsions.

Example 2

Preparation of Emulsions Em-f, Em-g, & Em-h

A tabular AgBrI emulsion having the same halogen composition and structure as a chemically unsensitized emulsion of the emulsion Em-a was prepared as an emulsion Em-f. This emulsion Em-f had an average grain diameter of 0.34 μm as the diameter of sphere having the same volume as a Following the same procedure as in Example 1, coating of the emulsions Em-A, Em-A', Em-A", Em-F, Em-F', Em-F", Em-G, Em-G', Em-G", Em-H, Em-H', and Em-H" was performed to obtain samples 201 to 212. These samples were given appropriate sensitometry exposure (1 sec) with light transmitted through a Fuji Filter SC-50 and subjected to black-and-white development at 20° C. for 10 min by using the developer D-19 having the following composition. After that, each resultant sample was stopped, fixed, washed with water, and dried by conventional methods, and the density of the sample was measured. Table 4 below shows the resultant photographic properties.

TABLE 4

| Sample No. | Emulsion | Fogging (Optical density) | Relative sensitivity (log E) | Increment in sensitivity obtained by the addition of $AgNO_3$ during chemical sensitization | |
|---|---|---|---|---|---|
| 201 | Em-A | 0.05 | 0.00 | — | Comparison |
| 202 | Em-A' | 0.06 | +0.23 | +0.23 | Invention |
| 203 | Em-A" | 0.04 | +0.05 | +0.05 | Comparison |
| 204 | Em-F | 0.05 | +0.34 | — | Comparison |
| 205 | Em-F' | 0.06 | +0.54 | +0.20 | Invention |
| 206 | Em-F" | 0.04 | +0.37 | +0.03 | Comparison |
| 207 | Em-G | 0.05 | +0.54 | — | Comparison |
| 208 | Em-G' | 0.05 | +0.72 | +0.18 | Invention |
| 209 | Em-G" | 0.04 | +0.57 | +0.03 | Comparison |
| 210 | Em-H | 0.06 | +0.71 | — | Comparison |
| 211 | Em-H' | 0.06 | +0.86 | +0.15 | Invention |
| 212 | Em-H" | 0.05 | +0.72 | +0.01 | Comparison |

Gold-sulfur-selenium-tellurium sensitization was optimally performed by using bis(diphenylcarbamoyl) ditelluride as a tellurium sensitizer in addition to the gold-sulfur-selenium sensitization in Example 2. Consequently, it was confirmed that a similar effect was obtained.

Example 3

Preparation of Em-E(1)

A chemically unsensitized emulsion of the emulsion Em-e in Example 1 was made to adsorb a dye S-a at 40° C. for 20 min, which was optimum in an optimal amount for performing chemical sensitization. The resultant emulsion was heated to 56° C., and gold-sulfur-selenium sensitization was optimally performed in the presence of potassium thiocyanate by using hypo as a sulfur sensitizer, N,N,-dimethylselenourea as a selenium sensitizer, and chloroauric acid as a gold sensitizer, thereby obtaining an emulsion Em-E (1).

Preparation of Em-E(2)–Em-E(7)

After the dye was adsorbed in the preparation of Em-E (1) above, an aqueous silver nitrate solution equivalent in amount to 0.5 mol % of the grains was added when the chemical sensitizers reacted 30%, 50%, 70%, and 90% and when 20 and 40 minutes elapsed after the chemical sensitizers reacted 100% during the gold-sulfur-selenium sensitization. The resultant emulsions were kept ripened or digested and optimally chemically sensitized to prepare emulsions Em-E(2), Em-E(3), Em-E(4), Em-E(5), Em-E(6), and Em-E(7). Note that the sensitivity was nearly saturated when 20 minutes elapsed after the 100% reaction, so the ripening of an emulsion to which silver nitrate was added after that, was immediately stopped.

Making of Sample 301

A multilayered color sensitive material constituted by layers having the following compositions was formed on an undercoated cellulose triacetate film support having a thickness of 127 μm, thereby making a sample 301. Numbers represent addition amounts per $m^2$. Note that the effects of the added compounds are not limited to those described below.

| | | |
|---|---|---|
| **1st layer: Antihalation layer** | | |
| Black colloidal silver | | 0.10 g |
| Gelatin | | 1.90 g |
| Ultraviolet absorbent U-1 | | 0.10 g |

-continued

| | | |
|---|---|---|
| Ultraviolet absorbent U-3 | | 0.040 g |
| Ultraviolet absorbent U-4 | | 0.10 g |
| High-boiling organic solvent Oil-1 | | 0.10 g |
| Fine crystal solid dispersion of dye E-1 | | 0.10 g |
| **2nd layer: Interlayer** | | |
| Gelatin | | 0.40 g |
| Compound Cpd-C | | 5.0 mg |
| Compound Cpd-I | | 5.0 mg |
| Compound Cpd-J | | 3.0 mg |
| High-boiling organic solvent Oil-3 | | 0.10 g |
| Dye D-4 | | 0.80 mg |
| **3rd layer: Interlayer** | | |
| Fine grain silver iodobromide emulsion having fogged surface and interior (average grain size = 0.06 μm, variation coefficient = 18%, AgI content = 1 mol %) | silver | 0.050 g |
| Yellow colloidal silver | silver | 0.030 g |
| Gelatin | | 0.40 g |
| **4th layer: Low-speed red-sensitive emulsion layer** | | |
| Emulsion A | silver | 0.30 g |
| Emulsion B | silver | 0.20 g |
| Gelatin | | 0.80 g |
| Coupler C-1 | | 0.15 g |
| Coupler C-2 | | 0.050 g |
| Compound Cpd-C | | 5.0 mg |
| Compound Cpd-J | | 5.0 mg |
| High-boiling organic solvent Oil-2 | | 0.10 g |
| Additive P-1 | | 0.10 g |
| **5th layer: Medium-speed red-sensitive emulsion layer** | | |
| Emulsion C | silver | 0.50 g |
| Gelatin | | 0.80 g |
| Coupler C-1 | | 0.20 g |
| Coupler C-2 | | 0.050 g |
| High-boiling organic solvent Oil-2 | | 0.10 g |
| Additive P-1 | | 0.10 g |
| **6th layer: High-speed red-sensitive emulsion layer** | | |
| Emulsion D | silver | 0.40 g |
| Gelatin | | 1.10 g |
| Coupler C-1 | | 0.30 g |
| Coupler C-2 | | 0.10 g |
| Coupler C-5 | | 0.02 g |
| Additive P-1 | | 0.10 g |
| **7th layer: Interlayer** | | |
| Gelatin | | 0.60 g |
| Additive M-1 | | 0.30 g |
| Color-mixing inhibitor Cpd-I | | 2.6 mg |
| Dye D-5 | | 0.020 g |
| Compound Cpd-J | | 5.0 mg |

-continued

| | | |
|---|---|---|
| High-boiling organic solvent Oil-2 | | 0.020 g |
| 8th layer: Interlayer | | |
| Gelatin | | 1.00 g |
| Additive P-1 | | 0.20 g |
| Color-mixing inhibitor Cpd-A | | 0.10 g |
| Compound Cpd-C | | 0.10 g |
| Compound Cpd-L | | 3.0 mg |
| 9th layer: Low-speed green-sensitive emulsion layer | | |
| Emulsion E | silver | 0.20 g |
| Emulsion F | silver | 0.30 g |
| Gelatin | | 0.50 g |
| Coupler C-3 | | 0.10 g |
| Coupler C-6 | | 0.050 g |
| Coupler C-7 | | 0.20 g |
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| Compound Cpd-K | | 0.020 g |
| High-boiling organic solvent Oil-1 | | 0.10 g |
| High-boiling organic solvent Oil-2 | | 0.10 g |
| 10th layer: Medium-speed green-sensitive emulsion layer | | |
| Emulsion G | silver | 0.40 g |
| Gelatin | | 0.60 g |
| Coupler C-3 | | 0.100 g |
| Coupler C-6 | | 0.200 g |
| Coupler C-7 | | 0.100 g |
| Compound Cpd-B | | 0.030 g |
| Compound Cpd-D | | 0.020 g |
| Compound Cpd-E | | 0.020 g |
| Compound Cpd-F | | 0.050 g |
| Compound Cpd-K | | 0.050 g |
| High-boiling organic solvent Oil-2 | | 0.010 g |
| 11th layer: High-speed green-sensitive emulsion layer | | |
| Emulsion H | silver | 0.50 g |
| Gelatin | | 1.00 g |
| Coupler C-3 | | 0.30 g |
| Coupler C-6 | | 0.10 g |
| Coupler C-7 | | 0.10 g |
| Compound Cpd-B | | 0.080 g |
| Compound Cpd-E | | 0.020 g |
| Compound Cpd-F | | 0.040 g |
| Compound Cpd-J | | 5.0 mg |
| Compound Cpd-K | | 0.020 g |
| High-boiling organic solvent Oil-1 | | 0.020 g |
| High-boiling organic solvent Oil-2 | | 0.020 g |
| 12th layer: Interlayer | | |
| Gelatin | | 0.60 g |
| Compound Cpd-K | | 0.050 g |
| High-boiling organic solvent Oil-1 | | 0.050 g |
| 13th layer: Yellow filter layer | | |
| Yellow colloidal silver | silver | 0.070 g |
| Gelatin | | 1.10 g |
| Color-mixing inhibitor Cpd-A | | 0.010 g |
| Compound Cpd-K | | 0.010 g |
| High-boiling organic solvent Oil-1 | | 0.010 g |
| Fine crystal solid dispersion of dye E-2 | | 0.050 g |
| 14th layer: Low-speed blue-sensitive emulsion layer | | |
| Emulsion I | silver | 0.20 g |
| Emulsion J | silver | 0.30 g |
| Gelatin | | 0.80 g |
| Coupler C-4 | | 0.20 g |
| Coupler C-5 | | 0.10 g |
| Coupler C-8 | | 0.40 g |
| 15th layer: Medium-speed blue-sensitive emulsion layer | | |
| Emulsion K | silver | 0.50 g |
| Gelatin | | 0.90 g |
| Coupler C-4 | | 0.10 g |
| Coupler C-5 | | 0.10 g |

-continued

| | | |
|---|---|---|
| Coupler C-8 | | 0.60 g |
| 16th layer: High-speed blue-sensitive emulsion layer | | |
| Emulsion L | silver | 0.40 g |
| Gelatin | | 1.20 g |
| Coupler C-4 | | 0.10 g |
| Coupler C-5 | | 0.10 g |
| Coupler C-8 | | 0.60 g |
| High-boiling organic solvent Oil-2 | | 0.10 g |
| 17th layer: 1st protective layer | | |
| Gelatin | | 0.70 g |
| Ultraviolet absorbent U-1 | | 0.20 g |
| Ultraviolet absorbent U-2 | | 0.050 g |
| Ultraviolet absorbent U-5 | | 0.30 g |
| Formalin scavenger Cpd-G | | 0.40 g |
| Dye D-1 | | 0.15 g |
| Dye D-2 | | 0.050 g |
| Dye D-3 | | 0.10 g |
| 18th layer: 2nd protective layer | | |
| Colloidal silver | silver | 0.10 mg |
| Fine grain silver iodobromide emulsion (average grain size = 0.06 μm, AgI content = 1 mol %) | silver | 0.10 g |
| Gelatin | | 0.40 g |
| 19th layer: 3rd protective layer | | |
| Gelatin | | 0.40 g |
| Polymethylmethacrylate (average grain size = 1.5 μm) | | 0.10 g |
| 4:6 copolymer of methylmethacrylate and acrylic acid (average grain size = 1.5 μm) | | 0.10 g |
| Silicone oil Cpd-S | | 0.030 g |
| Surfactant W-1 | | 3.0 mg |
| Surfactant W-2 | | 0.030 g |

In addition to the above compositions, additives F-1 to F-8 were added to all the emulsion layers. A gelatin hardener H-1 and surfactants W-3, W-4, W-5 and W-6 for coating and emulsification were also added to these layers.

Additionally, phenol, 1,2-benzisothiazoline-3-one, 2-phenoxyethanol, phenethylalcohol, and p-benzoic butylester were added as antiseptic and mildewproofing agents.

Preparation of Dispersion of Organic Solid Disperse Dye

A dye E-1 was dispersed by the following method. That is, water and 200 g of Pluronic F88 (ethyleneoxide-propyleneoxide block copolymer) manufactured by BASF Co. were added to 1430 g of a wet cake of a dye containing 30% of methanol, and the resultant material was stirred to form a slurry having a dye concentration of 6%. Subsequently, 1700 milliliter (hereinafter referred to as "mL") of zirconia beads with an average diameter of 0.5 mm were filled in an ultra visco mill (UVM-2) manufactured by Aimex K.K., and the material was milled for 8 h at a peripheral speed of about 10 m/sec and a discharge amount of 0.5 L/min. The beads were removed by filtration, and water was added to dilute the material to have a dye concentration of 3%. Thereafter, the resultant material was heated at 90° C. for 10 h for stabilization. The average grain size of the resultant fine dye grains was 0.60 μm, and the expansion of the grain size distribution (grain size standard deviation×100/average grain size) of the grains was 18%.

Following the same procedure as above, solid dispersions of dyes E-2 and E-3 were prepared. The average grain sizes were 0.54 μm and 0.56 μm.

C-1
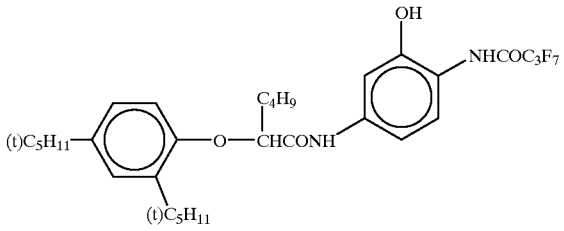
C-2
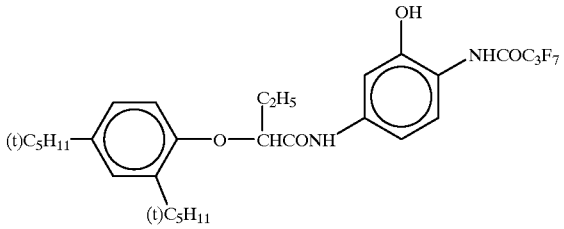
C-3
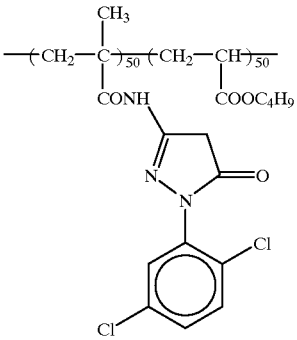
The numbers are expressed in wt%
Average mol. wt.: about 25,000
C-4
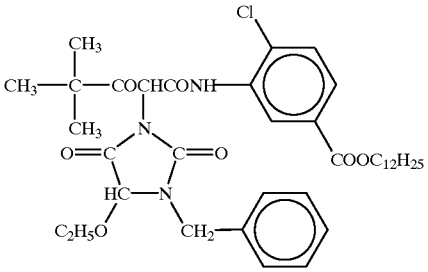
C-5
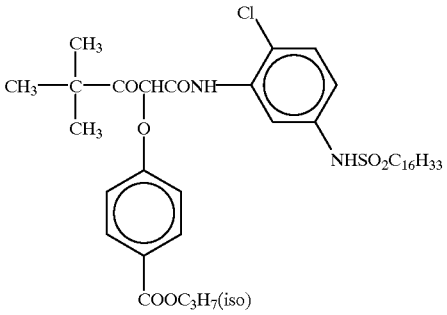
-continued
C-6
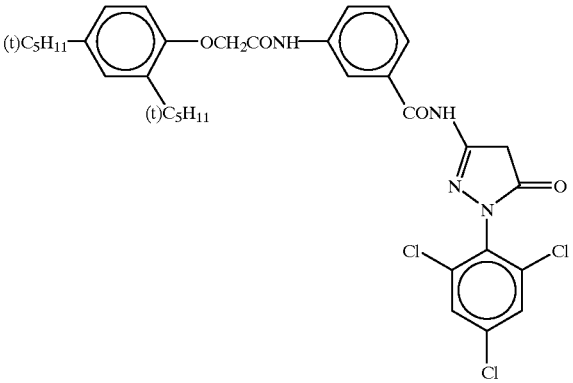
C-7
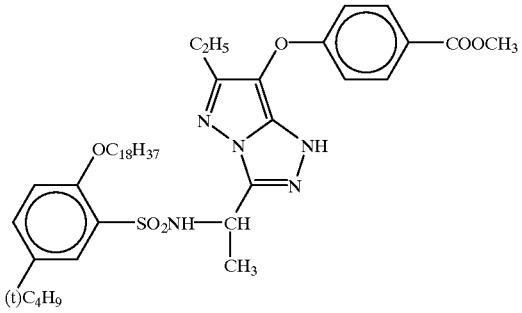
C-8
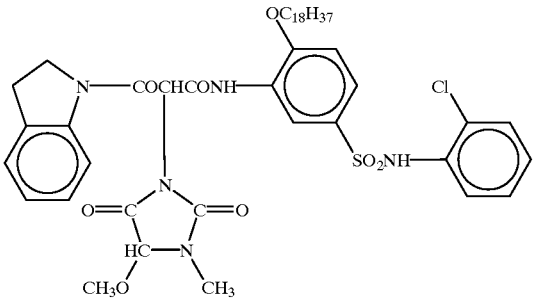
Oil-1
Dibutyl phtalate
Oil-2
Tricresyl phosphate
Oil-3
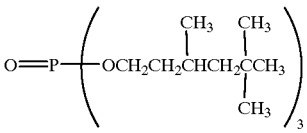
Cpd-A
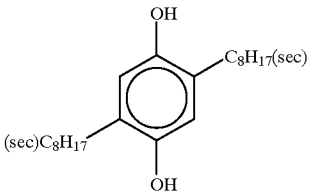

-continued
Cpd-B
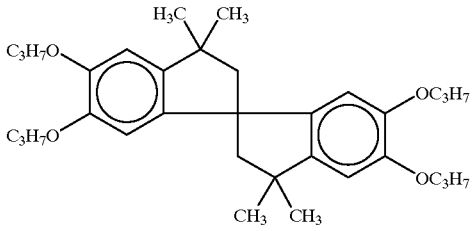
Cpd-C
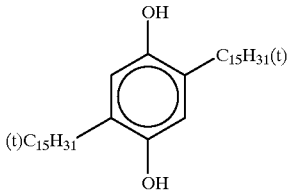
Cpd-D
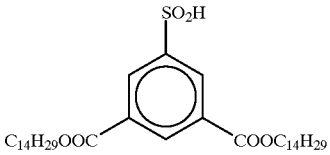
Cpd-E
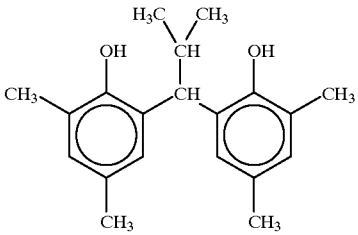
Cpd-F
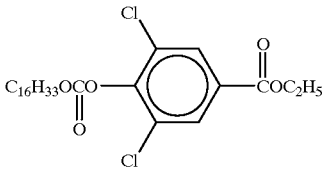
Cpd-G
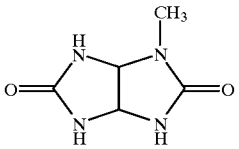
Cpd-I
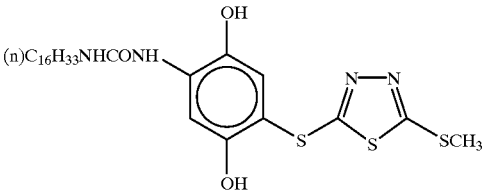
-continued
Cpd-J
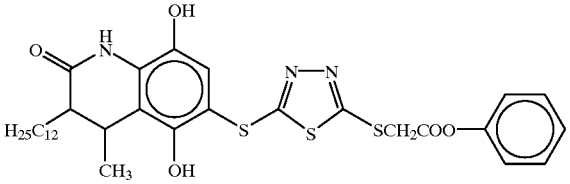
Cpd-K
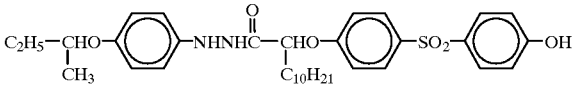
Cpd-L
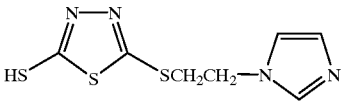
Cpd-S
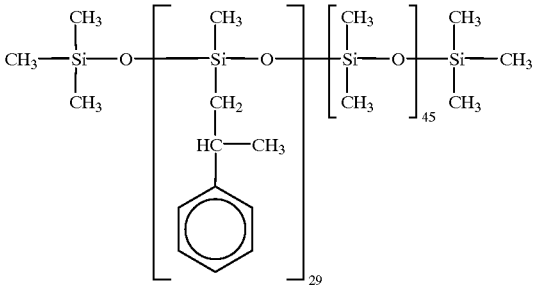
U-1
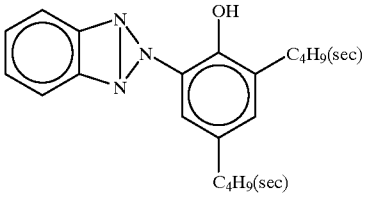
U-2
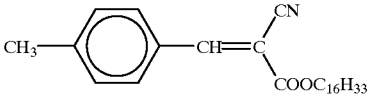
U-3
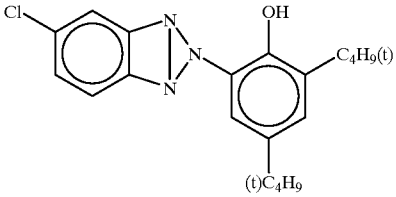
U-4
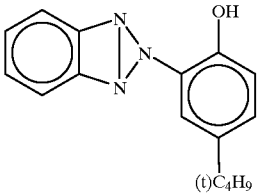

-continued
U-5
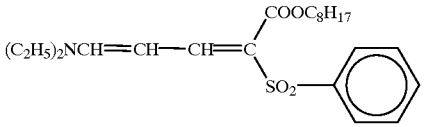
D-1
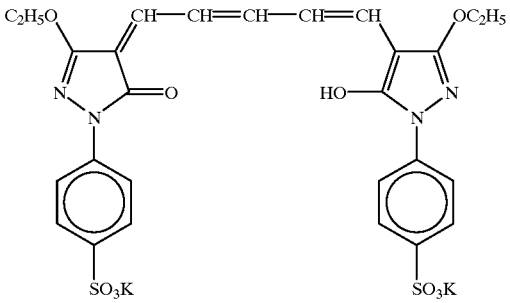
D-2
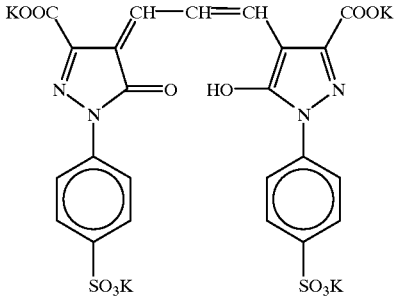
D-3
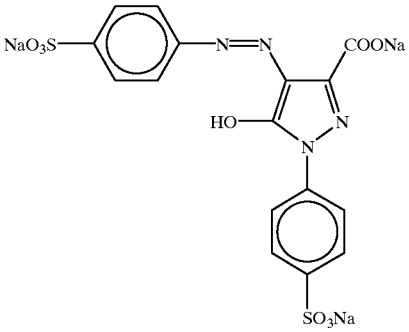
D-4
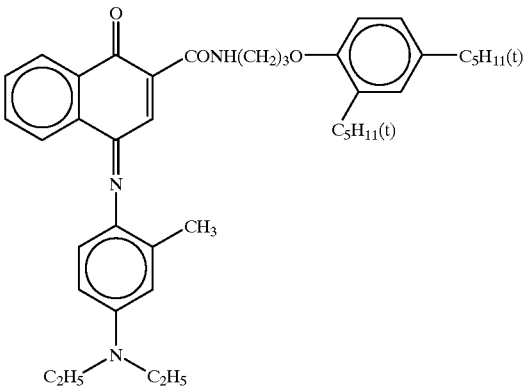
-continued
D-5
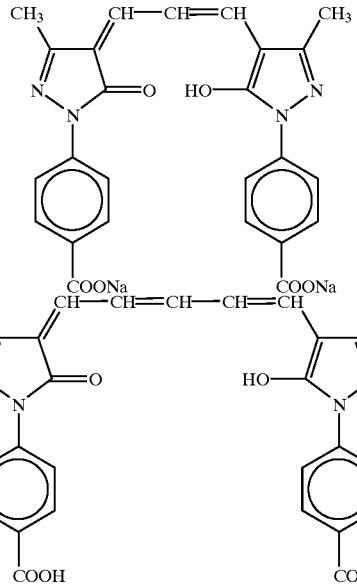
E-1
E-2
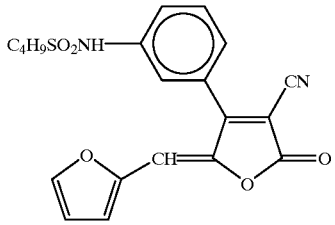
H-1
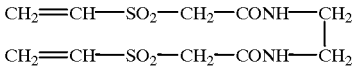
W-1
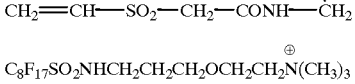
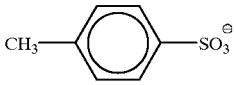
W-2
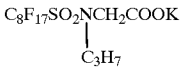
W-3
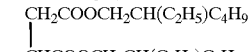
W-4
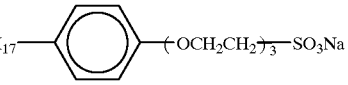
W-5
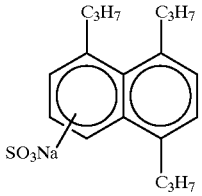
W-6
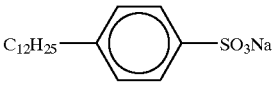
P-1
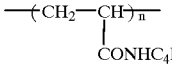
n = 100–1,000

-continued
M-1
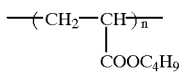
n = 100–1,000
F-1
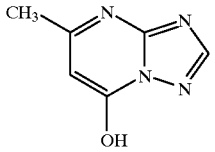
F-2
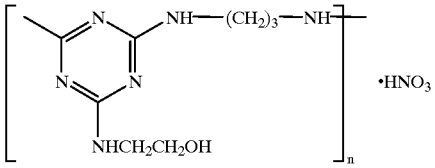
(n = 3–4)
F-3
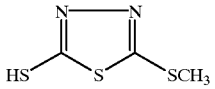
F-4
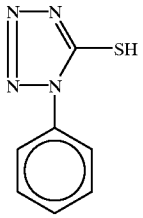
F-5
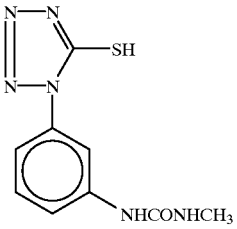
F-6
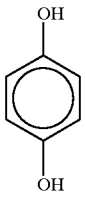
F-7
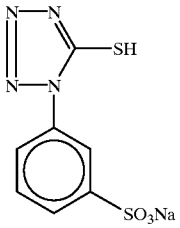
-continued
F-8
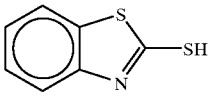
(S-a)
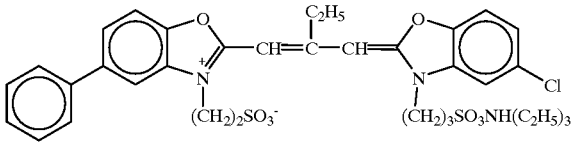
(S-1)
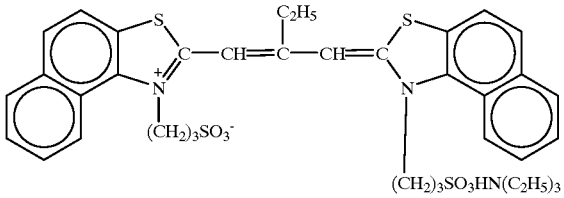
(S-2)
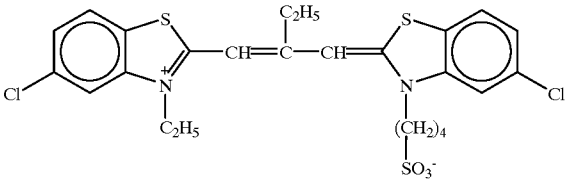
(S-3)
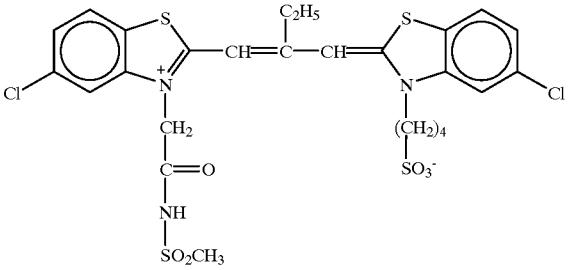
(S-4)
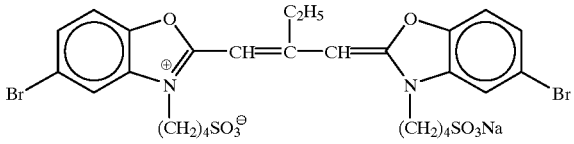
(S-5)
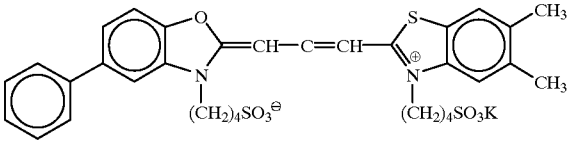
(S-6)
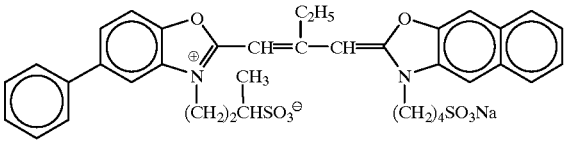

-continued (S-7)

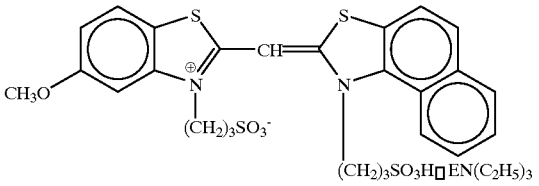

(S-8)

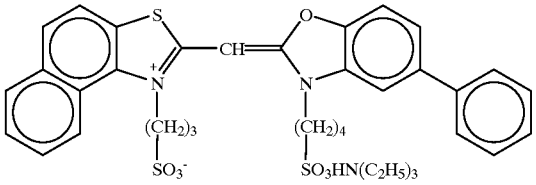

The silver bromoiodide emulsions used in the sample 301 were as follows.

TABLE 5

| Emulsion | Characteristics of grains | Average equivalent spherical diameter (μm) | Ratio in terms of projected area (%) | Coefficient of variation in distribution of grain size (%) | AgI content (%) |
|---|---|---|---|---|---|
| A | Tabular grains Average aspect ratio: 5.0 | 0.20 | 60 | 25 | 3.5 |
| B | Internally fogged tabular grains Average aspect ratio: 5.0 | 0.25 | 65 | 25 | 3.5 |
| C | Tabular grains Average aspect ratio: 8.0 | 0.31 | 95 | 25 | 3.0 |
| D | Tabular grains Average aspect ratio: 7.1 | 0.56 | 97 | 15 | 2.0 |
| E | Tabular grains Average aspect ratio: 3.5 | 0.15 | 60 | 30 | 4.0 |
| F | Tabular grains Average aspect ratio: 5.0 | 0.25 | 85 | 25 | 4.0 |
| G | Tabular grains Average aspect ratio: 8.0 | 0.33 | 99 | 15 | 3.2 |
| H | Tabular grains Average aspect ratio: 10 | 0.68 | 99 | 8 | 2.8 |
| I | Tabular grains Average aspect ratio: 5.0 | 0.27 | 80 | 20 | 4.6 |
| J | Tabular grains Average aspect ratio: 8.0 | 0.45 | 98 | 15 | 4.6 |
| K | Tabular grains Average aspect ratio: 8.0 | 0.45 | 98 | 8 | 2.0 |
| L | Tabular grains Average aspect ratio: 10 | 0.81 | 99 | 8 | 1.0 |

TABLE 6

| Spectral sensitization of emulsions | | | |
|---|---|---|---|
| Emulsion | Spectral sensitizer added | Addition amount per mol of silver halide (g) | Timing when the spectral sensitizers were added |
| A | S-1 | 0.025 | During grain formation |
| | S-3 | 0.40 | |
| | S-2 | 0.01 | |
| B | S-1 | 0.01 | During grain formation |
| | S-3 | 0.40 | |

TABLE 6-continued

| Spectral sensitization of emulsions | | | |
|---|---|---|---|
| Emulsion | Spectral sensitizer added | Addition amount per mol of silver halide (g) | Timing when the spectral sensitizers were added |
| C | S-1 | 0.01 | Before chemical sensitization |
| | S-3 | 0.30 | |
| | S-2 | 0.10 | |
| D | S-1 | 0.014 | Before chemical sensitization |
| | S-3 | 0.38 | |
| E | S-4 | 0.5 | Immediately after grain formation |
| | S-6 | 0.1 | |
| F | S-4 | 0.40 | Immediately after grain formation |
| | S-6 | 0.1 | |
| G | S-4 | 0.30 | Before chemical sensitization |
| | S-5 | 0.08 | |
| H | S-4 | 0.25 | Before chemical sensitization |
| | S-5 | 0.06 | |
| | S-6 | 0.05 | |
| I | S-7 | 0.07 | Immediately after grain formation |
| | S-8 | 0.45 | |

TABLE 6-continued

| Emulsion | Spectral sensitizer added | Addition amount per mol of silver halide (g) | Timing when the spectral sensitizers were added |
|---|---|---|---|
| | Spectral sensitization of emulsions | | |
| J | S-7<br>S-8 | 0.05<br>0.30 | Immediately after grain formation |
| K | S-7<br>S-8 | 0.05<br>0.25 | Before chemical sensitization |

Evaluation of Samples

Evaluation of Sensitivity and Fog

The made samples 301 to 308 were wedge-exposed at 2000 lux for 1/50 sec by using a white light source at a color temperature of 4,800 K and developed as follows. After that, the sensitivity was measured as a relative value of a reciprocal (E) of a relative exposure amount by which a magenta density of 0.2 was given by a G filter. Table 7 shows the relative values with respect to a standard value of 100 of the sample 301. Note that the sensitivity at which the magenta density is 0.2 is primarily brought about by a green-sensitive low-speed emulsion and a decrease in the magenta maximum density can be estimated as the fog of the green-sensitive emulsion.

| Sample No. | Emulsion | Average grain diameter of sphere having the same volume (μm) | Diameter of projected area (μm) | Aspect ratio | Timing when $AgNO_3$ solution is added | Fogging [Decrement in magenta density] | Sensitivity (log E) | |
|---|---|---|---|---|---|---|---|---|
| 301 | Em-E(1) | 0.23 | 0.28 | 2.7 | — | 0.08 | 0.00 | Comparison |
| 302 | Em-E(2) | 0.23 | 0.28 | 2.7 | After reaction of chemical sensitizer proceeded 30% | 0.08 | −0.05 | Comparison |
| 303 | Em-E(3) | 0.23 | 0.28 | 2.7 | After reaction of chemical sensitizer proceeded 50% | 0.08 | +0.08 | Invention |
| 304 | Em-E(4) | 0.23 | 0.28 | 2.7 | After reaction of chemical sensitizer proceeded 70% | 0.08 | +0.10 | Invention |
| 305 | Em-E(5) | 0.23 | 0.28 | 2.7 | After reaction of chemical sensitizer proceeded 90% | 0.08 | +0.13 | Invention |
| 306 | Em-E(6) | 0.23 | 0.28 | 2.7 | After reaction of chemical sensitizer proceeded 100% + ripening for 20 min. | 0.09 | +0.08 | Invention |
| 307 | Em-E(7) | 0.23 | 0.28 | 2.7 | After reaction of chemical sensitizer proceeded 100% + ripening for 40 min. | 0.09 | +0.01 | Comparison |

TABLE 6-continued

| Emulsion | Spectral sensitizer added | Addition amount per mol of silver halide (g) | Timing when the spectral sensitizers were added |
|---|---|---|---|
| | Spectral sensitization of emulsions | | |
| L | S-7<br>S-8 | 0.40<br>0.20 | Before chemical sensitization |

Samples 302 to 308 were made by replacing the green-sensitive low-speed emulsions E and F in the ninth layer used in the making of the sample 301 with equal silver amounts of Em-E(1) to Em-E(7).

As is evident from Table 7 above, the samples had equivalent fog and high sensitivities when the chemical sensitizers reacted 50%, 70%, and 90% and when ripening (optimum ripening) was performed for 20 min after the 100% reaction. The RMS granularity values of these samples were equivalent.

(Processing Steps and Processing Solutions in Standard Development)

| Step | Time | Temperature | Tank volume | Quantity of replenisher |
|---|---|---|---|---|
| 1st development | 6 min. | 38° C. | 12 L | 2,200 mL/m$^2$ |
| Washing | 2 min. | 38° C. | 4 L | 7,500 mL/m$^2$ |
| Reversal | 2 min. | 38° C. | 4 L | 1,100 mL/m$^2$ |
| Color development | 6 min. | 38° C. | 12 L | 2,200 mL/m$^2$ |
| Pre-bleaching | 2 min. | 38° C. | 4 L | 1,100 mL/m$^2$ |

-continued

| Step | Time | Temperature | Tank volume | Quantity of replenisher |
|---|---|---|---|---|
| Bleaching | 6 min. | 38° C. | 12 L | 220 mL/m$^2$ |
| Fixing | 4 min. | 38° C. | 8 L | 1,100 mL/m$^2$ |
| Washing | 4 min. | 38° C. | 8 L | 7,500 mL/m$^2$ |
| Final rinsing | 1 min. | 25° C. | 2 L | 1,100 mL/m$^2$ |

The compositions of the processing solutions were as follows.

| <1st developer> | Tank solution | Replenisher |
|---|---|---|
| Nitrilo-N,N,N-trimethylene phosphonic acid-pentasodium salt | 1.5 g | 1.5 g |
| Diethylenetriamine pentaacetic acid-pentasodium salt | 2.0 g | 2.0 g |
| Sodium sulfite- | 30 g | 30 g |
| Hydroquinone-potassium monosulfonate | 20 g | 20 g |
| Potassium carbonate | 15 g | 20 g |
| Sodium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was controlled by hydrochloric acid or potassium hydroxide.

| <Reversal solution> | Tank solution | Replenisher |
|---|---|---|
| Nitrilo-N,N,N-trimethylene phosphonic acid-solution pentasodium salt | 3.0 g | the same as tank |
| Stannous chloride-dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.0 | |

The pH was controlled by acetic acid or sodium hydroxide.

| <Color developer> | Tank solution | Replenisher |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon amidoethyl)-3-methyl-4 | 11 g | 11 g |

-continued

| <Color developer> | Tank solution | Replenisher |
|---|---|---|
| aminoaniline · ½ sulfuric acid · monohydrate | | |
| 3,6-dithiaoctane-1,8-diol | 1.0 g | 1.0 g |
| Water to make | 1,000 mL | 1,000 mL |
| pH | 11.80 | 12.00 |

The pH was controlled by hydrochloric acid or potassium hydroxide.

| <Pre-bleaching solution> | Tank solution | Replenisher |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was controlled by acetic acid or sodium hydroxide.

| <Bleaching solution> | Tank solution | Replenisher |
|---|---|---|
| Ethylenediaminetetraacetic acid · disodium salt · dihydrate | 2.0 g | 4.0 g |
| Ethylenediaminetetraacetic acid · Fe(III) · ammonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was controlled by nitric acid or sodium hydroxide.

| <Fixing solution> | Tank solution | Replenisher |
|---|---|---|
| Ammonium thiosulfate | 80 g | the same as tank solution |
| Sodium sulfite | 5.0 g | |
| Sodium bisulfite | 5.0 g | |
| Water to make | 1000 mL | |
| pH | 6.60 | |

The pH was controlled by acetic acid or ammonia water.

| <Final rinsing solution> | Tank solution | Replenisher |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide emulsion containing chemically sensitized silver halide grains, wherein the silver halide grains are prepared by ripening silver halide grains to be digested by the addition of (1) fine silver halide grains smaller than the silver halide grains to be digested, (2) a solution containing silver ions, (3) a solution containing halide ions and a solution containing silver ions, or (4) a fine silver halide grain emulsion and a solution containing silver ions;

wherein the amount of the addition in terms of silver ion is 0.05 to 8 mol % per mol of silver in the silver halide grains to be digested; and the addition is performed after 40% or more of the reaction of chalcogen sensitizer that is added during the chemical sensitization step is completed and before the silver halide grains are optimally ripened.

2. The silver halide emulsion according to claim 1, wherein the silver halide grains are tabular silver halide grains having an aspect ratio of 2 to 30 and the variation coefficient of the aspect ratio is 30% or less.

3. The silver halide emulsion according to claim 1, wherein the average silver iodide content of the silver halide grains is 0.5 to 10 mol %.

4. The silver halide emulsion according to claim 2, wherein the average silver iodide content of the silver halide grains is 0.5 to 10 mol %.

5. The silver halide emulsion according to claim 1, wherein the silver halide grains are subjected to gold-sulfur-selenium sensitization.

6. The silver halide emulsion according to claim 2, wherein the silver halide grains are subjected to gold-sulfur-selenium sensitization.

7. The silver halide emulsion according to claim 3, wherein the silver halide grains are subjected to gold-sulfur-selenium sensitization.

8. The silver halide emulsion according to claim 1, wherein the fine silver halide grains or solution containing halide ions to be added during the chemical sensitization step contains 20 mol % or less of iodide ions.

9. The silver halide emulsion according to claim 2, wherein the fine silver halide grains or solution containing halogen ions to be added during the chemical sensitization step contains 20 mol % or less of iodide ions.

10. The silver halide emulsion according to claim 3, wherein the fine silver halide grains or solution containing halogen ions to be added during the chemical sensitization step contains 20 mol % or less of iodide ions.

11. The silver halide emulsion according to claim 5, wherein the fine silver halide grains or solution containing halogen ions to be added during the chemical sensitization step contains 20 mol % or less of iodide ions.

12. The silver halide emulsion according to claim 1, wherein the fine silver halide grains or solution containing halide ions to be added during the chemical sensitization process contains 10 mol % or less of chloride ions.

13. The silver halide emulsion according to claim 2, wherein the fine silver halide grains or solution containing halogen ions to be added during the chemical sensitization process contains 10 mol % or less of chloride ions.

14. The silver halide emulsion according to claim 3, wherein the fine silver halide grains or solution containing halogen ions to be added during the chemical sensitization process contains 10 mol % or less of chloride ions.

15. The silver halide emulsion according to claim 5, wherein the fine silver halide grains or solution containing halogen ions to be added during the chemical sensitization process contains 10 mol % or less of chloride ions.

16. The silver halide emulsion according to claim 8, wherein the fine silver halide grains or solution containing halogen ions to be added during the chemical sensitization process contains 10 mol % or less of chloride ions.

17. A method of manufacturing a silver halide emulsion containing chemically sensitized silver halide grains, wherein the silver halide grains are prepared by ripening silver halide grains to be digested by the addition of (1) fine silver halide grains smaller than the silver halide grains to be digested, (2) a solution containing silver ions, (3) a solution containing halide ions and a solution containing silver ions, or (4) a fine silver halide grain emulsion and a solution containing silver ions;

wherein the amount of the addition in terms of silver ion is 0.05 to 8 mol % per mol of silver in the silver halide grains to be digested; and the addition is performed after 40% or more of the reaction of chalcogen sensitizer that is added during the chemical sensitization step is completed and before the silver halide grains are optimally ripened.

18. A silver halide photosensitive material having at least one light-sensitive silver halide emulsion layer on a support, wherein the light-sensitive silver halide emulsion layer contains the silver halide emulsion according to claim 1.

19. A method of image-wise exposing and developing the silver halide photosensitive material according to claim 18, wherein the method comprises a processing step performed in a developer in which a solution physical development occurs.

20. The silver halide emulsion according to claim 1, wherein the emulsion temperature, pH and pAg during the chemical sensitization step is 30 to 90° C., 4 to 9, and 7 to 10, respectively.

* * * * *